United States Patent [19]

Rosenkrantz et al.

[11] 4,056,228

[45] Nov. 1, 1977

[54] AROMA SYSTEM

[76] Inventors: Evelyn S. Rosenkrantz; Edward Rosenkrantz, both of 4915 Tyrone Ave., Sherman Oaks, Calif. 91403

[21] Appl. No.: 686,466

[22] Filed: May 14, 1976

[51] Int. Cl.[2] ..... B05B 15/00

[52] U.S. Cl. ..... 239/274; 239/333; 4/222

[58] Field of Search ..... 239/274, 333; 4/222, 4/224, 228

[56] References Cited

U.S. PATENT DOCUMENTS

| | | | |
|---|---|---|---|
| 2,586,266 | 2/1952 | Santarelli | 239/333 X |
| 2,795,799 | 6/1957 | Dickerman | 239/274 X |
| 3,182,337 | 5/1965 | Price | 4/222 |

FOREIGN PATENT DOCUMENTS

| | | | |
|---|---|---|---|
| 954,013 | 12/1976 | Germany | 239/333 |

*Primary Examiner*—John J. Love

*Attorney, Agent, or Firm*—Paul J. Sutton

[57] ABSTRACT

The present invention provides an aroma system including a spray deodorant apparatus for use with toilets and the like. The spray deodorant apparatus is simply attached to a toilet and releases a deodorant liquid spray or mist when an aroma flush handle is actuated. The spray deodorant apparatus is positioned on the toilet housing, allowing the aroma flush handle to be positioned under a toilet handle, thereby enabling the deodorant liquid spray or mist to be released as the toilet is flushed.

1 Claim, 6 Drawing Figures

AROMA SYSTEM

This invention relates generally to devices which can be used to eliminate offensive odors such as those found in bathrooms and the like. In particular, this invention presents an improved method of supplying a deodorant liquid spray to the immediate vicinity of the odor, thereby counteracting the odor in as short a time as possible.

Many people who use private bathrooms and also those persons who patronize public rest rooms are aware of the odors associated with these rooms, in spite of the fact that they may be cleaned and well taken care of. Within many of these rooms, particularly public rest rooms, persons can find many devices which are designed to dispense deodorants in an ineffective state for the simple reason that these devices do not adequately and timely serve to suppress odors.

Many efforts to solve this problem have been made and are known to the art. A search of U.S. Patent Office records will show a host of prior art patents which attempt to solve the problem of deodorizing offensive odors.

Let us now look at certain prior art patents which, while not anticipatory of the present invention, disclose representative examples of previous or known efforts to solve some of the problems associated with the art embodying this invention.

U.S. Pat. No. 598,053 to Lewis is an early attempt to counter unpleasant odors in bathrooms and the like. The general elimination of unpleasant odors is desirable in order to enable a person who uses the bathroom to be comfortable while using its facilities.

Lewis' patent discloses that when paper is drawn from a roll 34, a disk 35 is rotated. A pin 36 fixed to the disk 35 engages the forward end of a lever 20 and elevates said forward end, thus depressing the valve 22 and allowing a small amount of disinfectant to run into a pan 11. The disinfectant held in the pan 11 will then evaporate. One problem inherent in Lewis' patent is the need for obtaining sufficient force from the paper being drawn from the roll to operate the mechanism without tearing the paper. A second problem is the lack of a positive means for distributing the disinfectant to the room.

U.S. Pat. No. 1,293,405 to Goodhue represents another attempt to eliminate odor in bathrooms and the like. Goodhue utilizes air from a door check 1 mounted on a door 2 to supply air to an air pipe 3 connected to a sprayer 4 mounted within a bowl 5. Here Goodhue uses the energy available from the air contained within the door check 1 to spray a disinfectant into bowl 5. An obvious problem with this arrangement is the complexity of the installation. Secondly the disinfectant is released into the bowl after the occupant leaves the room.

Cohn's U.S. Pat. No. 2,539,059 provides for the ejection of a deodorant from a cabinet 30 into a nearby space. The ejection occurs when a fan 21 is caused to rotate as a knob 42 is manipulated by a person desiring toilet paper. Although this is a possible solution to deodorizing a room it appears that the mechanical complexity of the apparatus can cause frequent malfunctioning.

U.S. Pat. No. 1,579,124 issued to MacGrath describes a disinfectant system for use with cash registers and the like. MacGrath provides a spray distribution system enabling all areas of the cash drawer to be reached. This patent appears to be only peripherally related to the present invention.

Merrick's U.S. Pat. No. 2,557,451 attempts to counter the problem of unpleasant odors in a bathroom, or the like, by depositing small quantities of a deodorant liquid 18 carried by a strip 54 onto a heating element 58. The deodorant liquid 18 is then vaporized by contact with the heating element 58. Merrick's invention is particularly applicable to deodorant liquids which do not vaporize easily and would not be as applicable at the present time when better formulations are available.

U.S. Pat. No. 2,570,934 issued to Foster contains a relatively flat receptacle 19 containing a disc-like cake 20 of deodorant. The water normally used for afterfill is conducted into the flat receptacle 19 and thence into the bowl. Foster's patent then improves on the delivery of a deodorant into the toilet bowl water supply but suffers from not dispensing the deodorant at the level of the toilet user.

Hartmann's U.S. Pat. No. 2,828,953 provides for a fan 52 to cause air to continuously flow over a wick 40 being saturated with a liquid deodorant. Hartmann's patent provides for the continuous release of deodorant material into the bathroom which can result in a high consumption of deodorant.

U.S. Pat. No. 3,119,649 issued to Mendolia provides for air, available from a door closing means 12, to force deodorant out of nozzle means 35 said deodorant is obtained from receptacle 31. Mendolia's patent provides for the deodorant to be discharged into the room after the user leaves the bathroom.

Copley's U.S. Pat. No. 3,134,544 covers a dispensing means for deodorant release which involves a more complicated mechanism than the present invention.

U.S. Pat. No. 3,420,445 issued to Inzerill discloses a housing containing an aerosol can or bomb 8 electrically connected to an off-on-off switch 50 located adjacent to and in contact with a toilet seat. When said toilet seat is depressed a shot of deodorant spray is released into the bathroom. Inzerill's apparatus is powered from house current available from a floor plug 46. Thus current is also available at off-on-off switch 50 and can be hazardous to a person using the toilet. Further the deodorant spray is released when a person first sits on the seat and by the time the deodorant is needed its strength may be diminished. Further when the deodorant spray can 8 is replaced alignment of the spray nozzle 11 may be a problem. Still further the complete apparatus has many parts each of which is subject to malfunction and this may cause the entire apparatus to be unreliable.

While I do not wish to minimize the inventiveness and efforts of the inventors associated with the aforesaid prior patents, and while these people may be attempting to solve a problem that is similar to some of the problems solved by the present invention, it is worth mentioning some of the drawbacks of these devices. In general, the previously discussed known inventions do not release the deodorant at the correct time. In some cases the deodorant is not released at an appropriate level in the room in order to be quickly sensed by a person using the bathroom. In other cases the deodorant is not expelled with a force which would cause it to carry into the room.

Accordingly it is an object of the present invention to provide a deodorant spray apparatus that can be conveniently and easily attached to an existing toilet tank with no modification of the tank.

Another object of this invention is to provide a deodorant spray apparatus which can be operated by depressing the toilet handle of a toilet. Yet another object of this invention is to release the deodorant at the same time as the toilet is flushed.

A further object of this invention is to provide a deodorant spray apparatus capable of fitting a variety of toilet tanks with a minimum of adjustment.

Still another object of this invention is to provide a spray refiner as part of the deodorant spray apparatus which will cause the deodorant spray to move in an upwardly direction.

Still yet another object of this invention is to provide an easily refillable deodorant spray apparatus.

My invention will be made more clearly understood from the following description of a specific embodiment of the invention, together with the accompanying drawings, wherein similar reference characters denote similar elements throughout the several views, and in which.

Figure 1:
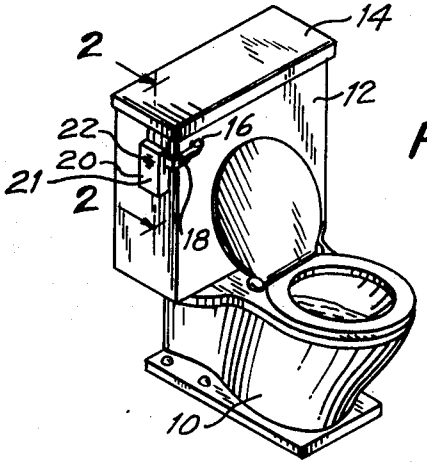
FIG. 1 is a perspective view of the flush box installed on a toilet tank.

Referring to the drawings in more detail, FIG. 1 illustrates a flush box 20 attached to a toilet tank 12 and aupported by a toilet bowl 10. The flush box 20 is supported on the topmose edge of the toilet tank 12 and is held in position by the weight of a toilet tank cover 14. Flush box 20 has protruding from its side a flush actuating handle 18 prearranged to be adjustably able to fit below a toilet handle 16 and, in a preferred embodiment of this invention, to make contact with the toilet handle 16. Integral with and forming part of a front surface 21 of the flush box 20 is a spray refiner 22 through which the spray or mist of a deodorant liquid 50 issues.

Figure 2:
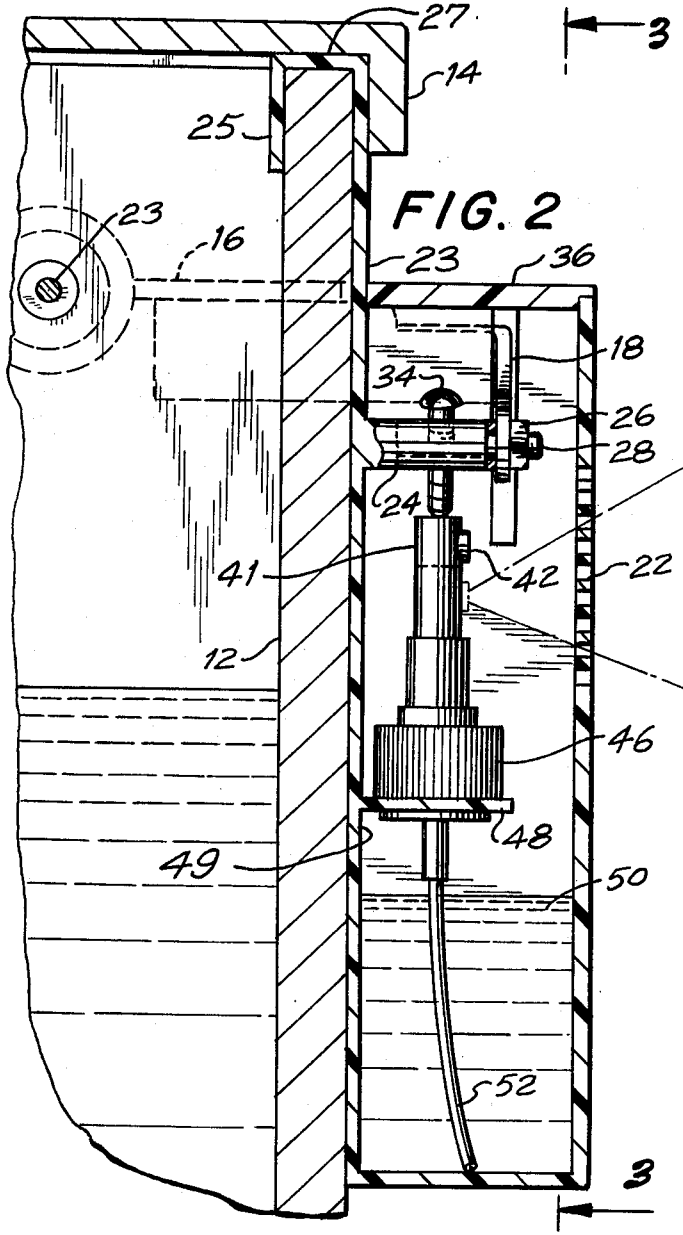
FIG. 2 is a partial sectional view taken on line 2 — 2 of FIG. 1.

FIG. 2 better illustrates the relationship between the flush box 20 and the toilet tank 12. A rear portion 23 of the flush box 20 has as its topmost rear surface a formed and downwardly facing U-shaped channes portion 25 which is adapted to fit upon a portion of the front top edge 27 or the toilet tank 12. The toilet tank cover 14 serves to hold flush box 20 in position and a flush box cover 36 serves to protect the deodorant liquid 50 within flush box 20 from contamination.

In operation, the toilet handle 16 is depressed in order to flush to toilet bowl 10, in the normal manner. Since toilet handle 16 normally abuts the upper surfaces of a lip portion 30 thereof which is formed as an integral part of flush handle 18, lip portion 30 will move in a downward direction as toilet handle 16 rotates about a toilet handle pivot 22. The downward movement of lip portion 30 will cause flush handle 18 to rotate in a clockwise direction about its pivot 28. Pivot 28 is secured to a flush handle pivot post 24 which is rigidly attached to the rear portion of flush box 20. Flush handle 18 maintains its relative alignment by means of the presence of a washer 27 and a locknut 26, both of which firmly secure the handle to its supportive mechanism.

Free movement of flush handle 18 is facilitated by providing a slot 38 in a side wall portion of flush box 20 nearest toilet handle 16. Flush handle 18 includes, as an integral part thereof, an apron 32 through which an adjusting screw 34 is threaded. Adjusting screw 34 contacts the actuating head 41 of a spray nozzle 42 and is adjusted to continually make contact with this head of the spray nozzle as the adjusting screw 34 arcuately moves in response to the movement of the flush handle 18.

A shelf 48 is either attached to or integrally formed in a predetermined manner with the rear wall 49 and side walls 51 of flush box 20. Shell 48 supports at its lateral center a spray nozzle pump assembly 44. Spray nozzle pump assembly 44 is detachable fixed to shelf 48 by means of a fastener 46, or other suitable means. Protruding from the base of spray nozzle 44 is a supply tube 52 which extends to and is immersed in the deodorant liquid 50. Tube 52 supplies the deodorant liquid 50 to the spray nozzle pump assembly 44. Spray nozzle 42 is positioned within flush box 20 in order to spray the deodorant liquid 50 through the spray refiner 22.

Figure 3:
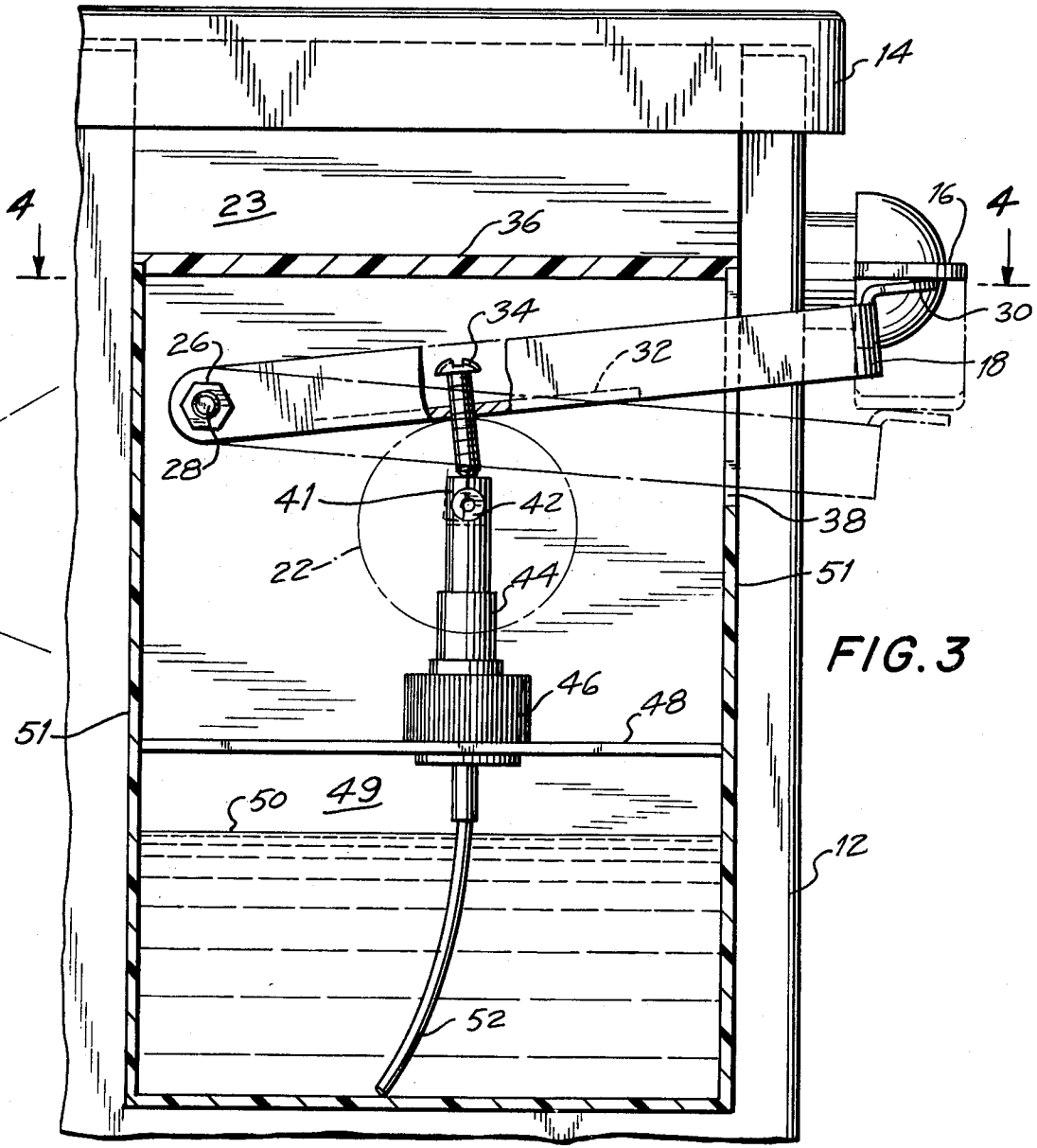
FIG. 3 is a partial sectional view taken on line 3 — 3 on FIG. 2.

FIG. 3 more clearly illustrates the pre-spray position of the flush handle 18 and the abutting relationship of lip 30 with toilet handle 16. Adjusting screw 34 is adjusted so as to abut the topmost portion of spray nozzle 42 when the head 41 of spray nozzle 42 is in its uppermost position. As a person causes the toilet to be flushed, the user must push the flat portion of the toilet handle 16 in a downward direction, and the flush handle 18 assumes the dotted or phantom outline position. When the flush handle 18 assumes this dotted position, adjusting screw 34 has caused spray nozzle 44 to move in a downward direction. This downward movement enables the deodorant liquid 50 contained within the spray nozzle assembly 44 to be expelled from spray nozzle 42 through the action of pump 44, as a deodorant liquid mist or spray. The deodorant liquid spray issues from the spray nozzle uniformly distributed as shown by dotted lines in FIG. 2.

Also shown in FIG. 2 is the redirection of the deodorant liquid spray as it traverses the spray refiner 22. This spray redirection, which is the function of the spray refiner 22, is designed to deflect or direct the spray in an upward direction in the room, such that the deodorant may be better sensed by persons in the room.

Figure 5:
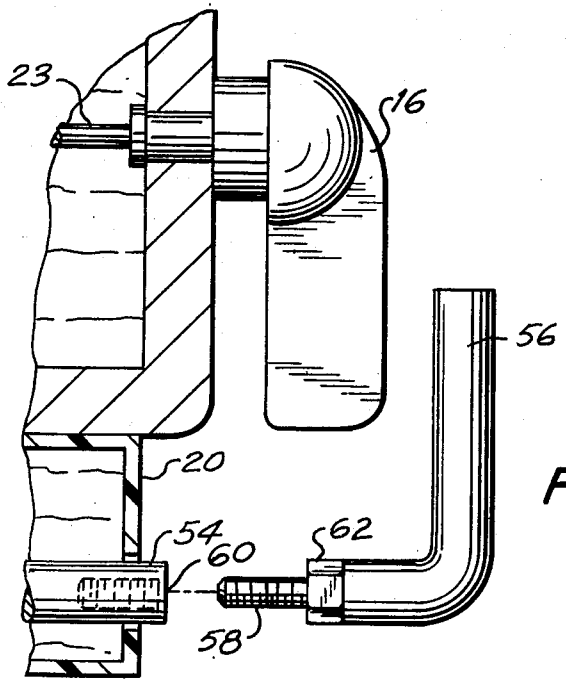
FIG. 5 is a partial sectional view similar to FIG. 4 showing an alternate form of flush handle.

FIG. 5 illustrates an alternate form of flush handle. A flush handle 54 is preferably made of rod material and is formed with an internal thread 60 which is matingly engaged by a threaded stud 58. The threaded stud 58 is rigidly attached to a bent rod 56 or other preformed material shape which, in turn, fits under the toilet handle 16 when the threaded stud 58 is engaged with the internal thread 60. A locknut 62 serves to permit adjustment of the bent rod 56 relative to the toilet handle 16. One of the principal benefits derived from the handle design shown in FIG. 5 resides in the ability of the user to accurately adjust the actuating position of handle 56.

Figure 4:
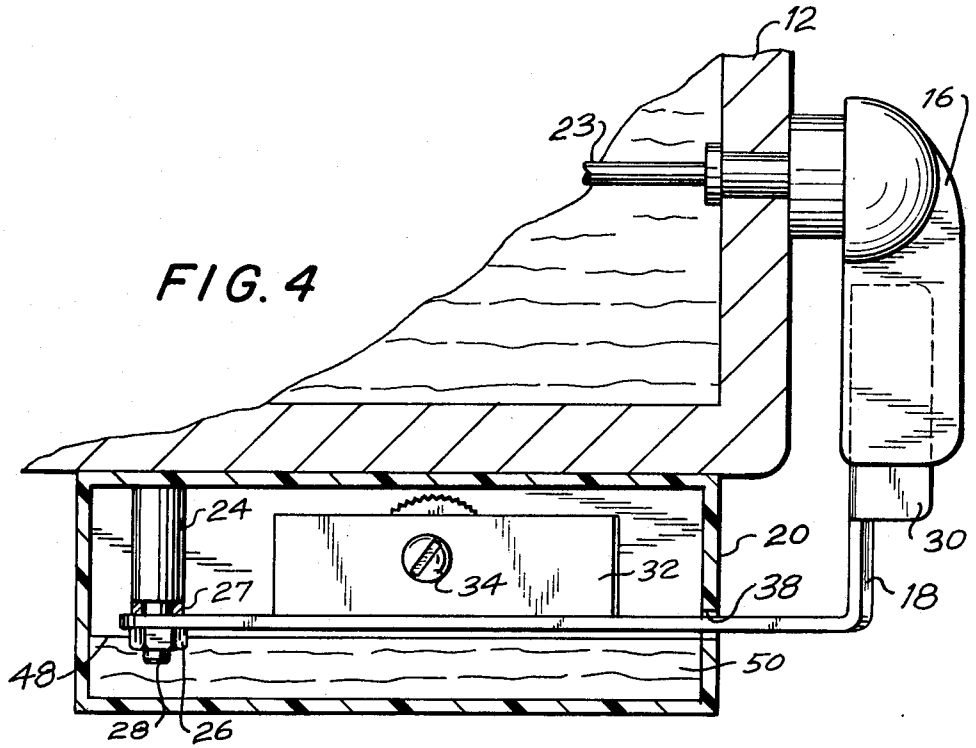
FIG. 4 is a partial sectional view taken on line 4 — 4 of FIG. 3.
Figure 6:
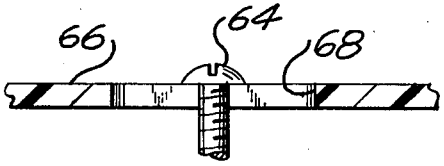
FIG. 6 is a partial sectional view similar to FIG. 3 showing an alternate form of adjusting screw.

FIG. 6 illustrates an alternate form of adjusting screw 64, wherein the screw protrudes through an opening in the top of the housing for accessability and for ease in adjustment. Adjusting screw 64 is supported by an apron 32, not shown, and protrudes through a slot 68 suitable disposed in a flush box cover 66.

The embodiments of the invention particularly disclosed and described herein above are presented merely as examples of our invention. Other embodiments, forms and modifications of the invention coming within the proper scope and spirit of the appended claims will, of course, readily suggest themselves to those skilled in the art.

What is claimed is:

1. An aroma emitting device for cooperative use with a toilet handle, or the like, comprising in combination: a housing, a refillable fluid reservoir carried by the housing, pump means communicating with said reservoir for generating a fluid mist, actuating means disposed in the path of a movable member for controllably and variably actuating said pump means so as to cause said mist to be generated proximate the movable member, said housing including an integral support wall extending at an elevation above that of the level of said fluid reservoir, said support wall comprising a shelf member extending substantially perpendicularly from and with respect to a substantially vertical wall making up said housing, said vertical housing wall extending upwardly to a downwardly facing U-shaped channel portion supported by upper edges of a wall of a toilet bowl holding water, said housing further including a removable and replaceable lid for enabling access to interior portions of said housing, said pump assembly including an outer housing supported integrally with said support wall shelf within the housing, a reciprocable plunger head carrying a spray nozzle, and a hollow dip tube communicating with said spray nozzle and extending below the level of said fluid, said actuating means comprising a bar member extending along an axis and pivotably supported by said support wall at an elevation above that of said plunger head, said bar member having substantially horizontal surfaces intermediate the junction of the bar member and said housing and its opposite end, said opposite end including an actuating portion extending at an angle from and with respect to said axis, said opposite end comprising adjustable alignment means for positioning said actuating portion in the path of more than one type and shape of conventional toilet handle, said adjustable alignment means including male and female threaded members and locking means for securing said male and female threaded members integrally together in one of several possible relative positions, threaded fastening means for pivotally securing said bar member to said support wall, and adjustable biasing means carried by said bar member for engaging said plunger head during use, said biasing means comprising a threaded member capable of being adjustably manipulated upon removal of said lid such that a lower end thereof may be positioned at varying elevations, said adjustability of the threaded member providing means for variable controlling the stroke of said pump plunger head and thus the characteristics of fluid spray mist from said spray nozzle and the quantities of fluid discharged as a result of depression of said toilet handle.

* * * * *